US009718299B2

(12) United States Patent
Dawson et al.

(10) Patent No.: US 9,718,299 B2
(45) Date of Patent: Aug. 1, 2017

(54) FLIPPABLE BOARD METHOD AND SYSTEM

(71) Applicants: Dony Dawson, Keller, TX (US); Robert Dilling, Fort Worth, TX (US)

(72) Inventors: Dony Dawson, Keller, TX (US); Robert Dilling, Fort Worth, TX (US)

(73) Assignee: CLARUS GLASSBOARDS, LLC, Fort Worth, TX (US)

( * ) Notice: Subject to any disclaimer, the term of this patent is extended or adjusted under 35 U.S.C. 154(b) by 22 days.

(21) Appl. No.: 14/981,969

(22) Filed: Dec. 29, 2015

(65) Prior Publication Data

US 2017/0182835 A1 Jun. 29, 2017

(51) Int. Cl.
*B43L 1/00* (2006.01)
*A47B 97/04* (2006.01)
*B43L 5/00* (2006.01)

(52) U.S. Cl.
CPC ..... *B43L 5/005* (2013.01); *B43L 1/008* (2013.01); *B43L 5/002* (2013.01)

(58) Field of Classification Search
CPC ..... A47B 97/001; B43L 1/008; B43L 1/045; B43L 5/002; B43L 5/005
USPC ..... 434/413, 414, 421
See application file for complete search history.

(56) References Cited

U.S. PATENT DOCUMENTS 5,010,671 A 4/1991 Stonehouse
6,304,377 B1 * 10/2001 Murr ..... G03B 21/58 160/127
7,293,993 B2 11/2007 Fedorov et al.
7,347,020 B2 3/2008 Ray et al.
7,823,309 B2 11/2010 Albenda
7,980,857 B2 7/2011 Cheris
(Continued)

FOREIGN PATENT DOCUMENTS

CN 2289693 Y 9/1998
CN 201300621 Y 9/2009
(Continued)

OTHER PUBLICATIONS

"Folding Magnetic Dry Erase Boards", Stonehouse Signs (pp. 2) http://stonehousesigns.com/folding-magnetic-dry-erase-boards.
(Continued)

*Primary Examiner* — James Hull
(74) *Attorney, Agent, or Firm* — Raj Abhyanker, P.C.

(57) ABSTRACT

Disclosed are a method and/or a system of a flippable board. In one aspect, the flippable board includes a track capable of attaching to a surface, a first hinge component and a second hinge component attached to the track, and a frame attached to the first and second hinge components along a first vertical end of the frame. The first and second hinge components allow the frame to rotate between an open position and a closed position. The flippable board further includes an adjustable left magnet and adjustable right magnet attached to the first and/or second hinge component, and at least one metal sleeve attached to a second vertical end of the frame capable of connecting to the left magnet and/or right magnet of a secondary flippable board and/or an adjustable surface magnet in order to secure the flippable board in the open and/or closed position.

20 Claims, 7 Drawing Sheets

(56) References Cited

U.S. PATENT DOCUMENTS

| | | | | |
|---|---|---|---|---|
| 8,047,851 | B1 * | 11/2011 | Baxter | B43K 23/001 434/408 |
| 8,596,600 | B2 | 12/2013 | Spencer et al. | |
| 2003/0079389 | A1 | 5/2003 | Eberly | |
| 2006/0225331 | A1 | 10/2006 | Evans | |
| 2007/0266607 | A1 | 11/2007 | Schult | |
| 2010/0192429 | A1 * | 8/2010 | Sadowski | G09F 11/02 40/1 |

FOREIGN PATENT DOCUMENTS

| | | | | |
|---|---|---|---|---|
| CN | 202517930 | U | 11/2012 | |
| CN | 202782335 | U | 3/2013 | |
| CN | 204488297 | U | 7/2015 | |
| EP | 0730419 | B1 | 4/2001 | |
| FR | 2561890 | A1 * | 10/1985 | A47B 97/001 |

OTHER PUBLICATIONS

"Drywipe Whiteboards", Spacesaver whiteboards (p. 1) www.red17.co.uk/.../spacesaver_whiteboard_specification_sheet.pdf.

* cited by examiner

FLIPPABLE BOARD METHOD AND SYSTEM

FIELD OF THE TECHNOLOGY

This invention relates generally to a writing board, and more particularly to a mounted flippable writing board.

BACKGROUND

A writing board may be a board used to temporarily write things down on. Users may decide to mount writing boards on walls. However, users may wish to be able to hide what is written on the writing boards from time to time on a temporary basis. This may require installing additional cabinets and/or structures in order to cover the writing boards mounted to the walls.

Alternatively, free standing writing boards may be used which can be flipped from front to back. However, this may take additional floor space and/or create hazards within a space. Therefore, free standing writing boards may be cumbersome, unsightly and/or dangerous.

Further, users of mounted writing boards may find that the mounted writing boards and/or the open floor space create poor acoustics. The users may need to install additional hardware and/or structures in order to improve the acoustics within the space. Therefore using a mounted writing board with a single surface may be burdensome, cumbersome, and/or costly when additional privacy and/or acoustic structures are needed.

SUMMARY

Disclosed are a method and/or a system of a flippable board.

In one aspect, the flippable board includes a track. The track is capable of being attached to a surface. The flippable board further includes a first hinge component attached to a top end of the track and a second hinge component attached to a bottom end of the track. In addition, the flippable board includes a frame attached to the first hinge component and the second hinge component along a first vertical end of the frame. The first hinge component and the second hinge component are capable of allowing the frame to rotate between an open position and/or a closed position about an axis along the first vertical end of the frame.

In addition, the flippable board includes a left magnet attached to a first hinge component left portion and/or a second hinge component left portion, and/or a right magnet attached to a first hinge component right portion and/or a second hinge component right portion. The flippable board further includes a metal sleeve attached to a top portion and/or a bottom portion of a second vertical end of the frame. The metal sleeve is capable of connecting to a left magnet of a secondary flippable board and/or the right magnet of the secondary flippable board and/or a surface magnet in order to secure the flippable board in the open position and/or the closed position. The surface magnet is attached to the surface and each of the left magnet, the right magnet, and/or the surface magnet is capable of being adjusted towards and/or away from the surface in order to compensate for inconsistencies in the surface.

The flippable board may further include a writing board attached to the frame and/or an acoustic panel. The acoustic panel may be capable of attaching to a back portion of the writing board. The writing board may be visible in the open position, and/or the acoustic panel may be visible in the closed position. Additionally, the flippable board may include a metal sheet attached to the back portion of the writing board and/or the panel magnet attached to the acoustic panel. The acoustic panel may be capable of attaching to the back portion of the writing board using the panel magnet. The writing board may be a glassboard.

The second hinge component may include a receptacle on a top portion of the second hinge component capable of retaining a writing instrument. The writing instrument may be capable of writing on the writing board. The first hinge component and/or the second hinge component may include pin hinges. The frame may include a top hole and/or a bottom hole on the first vertical end. The first hinge component may include a first pin hinge and/or the second hinge component may include a second pin hinge. The top hole may be capable of attaching to the first pin hinge and/or the bottom hole may be capable of attaching to the second pin hinge. The top hole and/or the bottom hole may be located such that the frame conceals the track mounted to the surface when the flippable board is in the open position and/or the closed position.

In another aspect, a method of a flippable board includes attaching a track to a surface. The method further includes attaching a first hinge component to a top end of the track and attaching a second hinge component to a bottom end of the track. A frame is attached to the first hinge component and the second hinge component along a first vertical end of the frame. The first hinge component and the second hinge component are capable of allowing the flippable board to rotate between an open position and/or a closed position about an axis along the first vertical end of the frame.

The left magnet is attached to a first hinge component left portion and/or a second hinge component left portion. The right magnet is attached to a first hinge component right portion and/or a second hinge component right portion. The metal sleeve is attached to a top portion and/or a bottom portion of a second vertical end of the frame. The metal sleeve is capable of connecting to the left magnet of a secondary flippable board, the right magnet of an secondary flippable board, and/or a surface magnet in order to secure the flippable board in the open position and/or the closed position. The surface magnet is attached to the surface. Each of the left magnet, the right magnet, and/or the surface magnet is capable of being adjusted towards and/or away from the surface in order to compensate for inconsistencies in the surface.

In yet another aspect, a system includes a primary flippable board and a secondary flippable board. Each flippable board includes a track attached to a surface, a first hinge component attached to a top end of the track, a second hinge component attached to a bottom end of the track, and a frame attached to the first hinge component and the second hinge component along a first vertical end of the frame. The first hinge component and the second hinge component are capable of allowing the frame to rotate between an open position and/or a closed position about an axis along the first vertical end of the frame.

Each flippable board further includes a left magnet attached to a first hinge component left portion and/or a second hinge component left portion, and a right magnet attached to a first hinge component right portion and/or a second hinge component right portion. Additionally, each flippable board includes a metal sleeve attached to a top portion and/or a bottom portion of a second vertical end of the frame. The track of the secondary flippable board is attached to the surface at a specific distance from the primary flippable board such that the metal sleeve of the primary flippable board is capable of connecting to the left magnet of the secondary flippable board and/or the right magnet of the secondary flippable board in order to secure the primary flippable board in the open position and/or the closed position.

The system further includes a surface magnet attached to the surface at the specific distance from the primary flippable board and/or the secondary flippable board such that the metal sleeve of the primary flippable board and/or the secondary flippable board is capable of connecting to the surface magnet in order to secure the primary flippable board and/or the secondary flippable board in the open position and/or the closed position. Each of the left magnet, the right magnet, and the surface magnet is capable of being adjusted towards and/or away from the surface in order to compensate for inconsistencies in the surface.

The methods and/or systems disclosed herein may be implemented in any means for achieving various aspects. Other features will be apparent from the accompanying drawings and from the detailed description that follows.

BRIEF DESCRIPTION OF THE FIGURES

Example embodiments are illustrated by way of example and not limitation in the figures of the accompanying drawings, in which like references indicate similar elements and in which.

Figure 1:
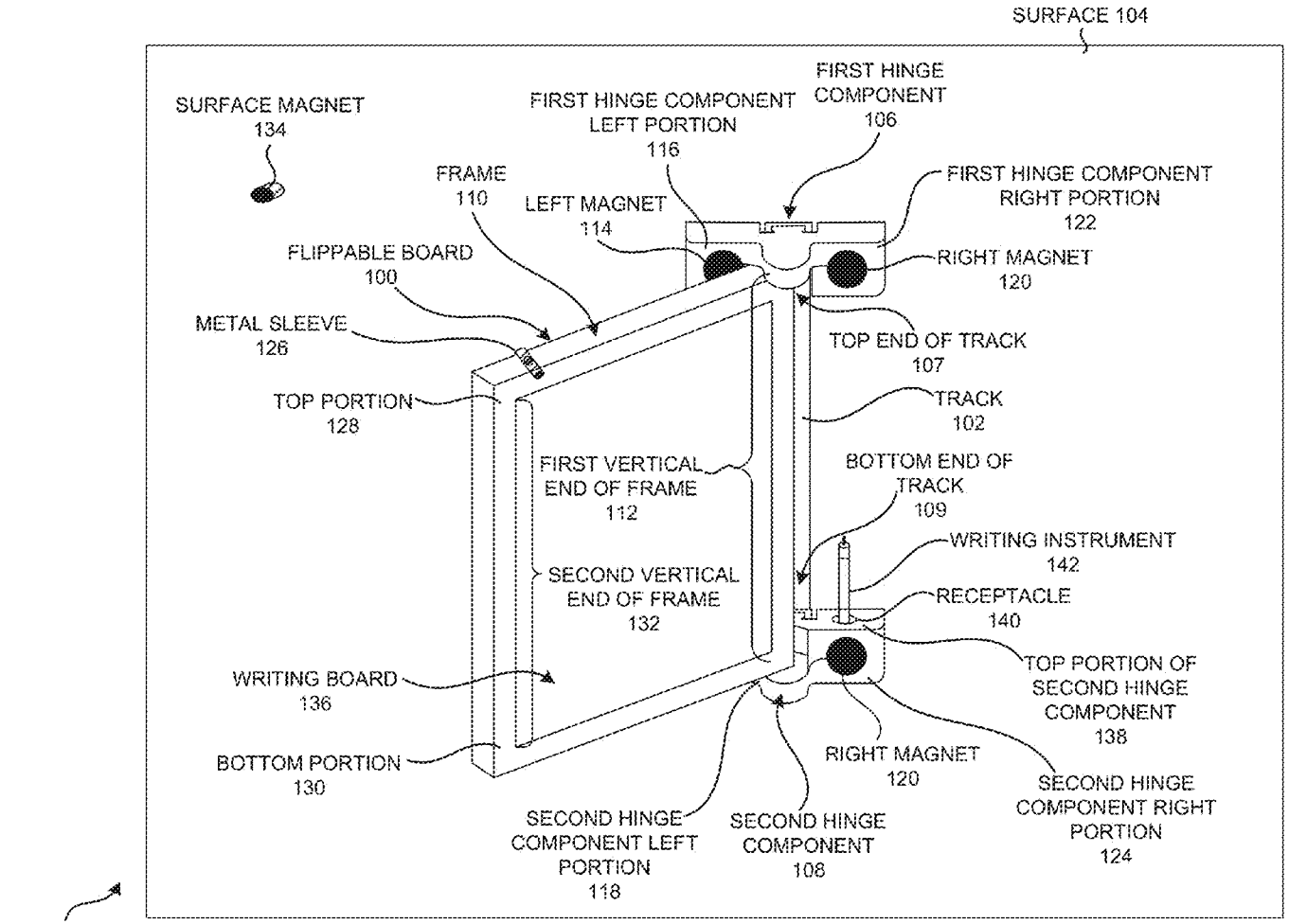
FIG. 1 is a flippable board view, according to one embodiment.

Other features of the present embodiments will be apparent from the accompanying drawings and from the detailed description that follows.

DETAILED DESCRIPTION

Disclosed are a method and/or a system of a flippable board 100. In one embodiment, the flippable board 100 includes a track 102. The track 102 is capable of being attached to a surface 104. The flippable board 100 further includes a first hinge component 106 attached to a top end of the track 107 and a second hinge component 108 attached to a bottom end of the track 109. In addition, the flippable board 100 includes a frame 110 attached to the first hinge component 106 and the second hinge component 108 along a first vertical end of the frame 112. The first hinge component 106 and the second hinge component 108 are capable of allowing the frame 110 to rotate between an open position 404 and/or a closed position 406 about an axis along the first vertical end 200 of the frame 110.

In addition, the flippable board 100 includes a left magnet 114 attached to a first hinge component left portion 116 and/or a second hinge component left portion 118, and/or a right magnet 120 attached to a first hinge component right portion 122 and/or a second hinge component right portion. The flippable board 100 further includes a metal sleeve 126 attached to a top portion 128 and/or a bottom portion 130 of a second vertical end of the frame 132. The metal sleeve 126 is capable of connecting to a left magnet 114 of a secondary flippable board 402, and/or the right magnet 120 of the secondary flippable board 402 and/or a surface magnet 134 in order to secure the flippable board 100 in the open position 404 and/or the closed position 406. The surface magnet 134 is attached to the surface 104 and each of the left magnet 114, the right magnet 120, and/or the surface magnet 134 is capable of being adjusted towards and/or away from the surface 104 in order to compensate for inconsistencies in the surface 104.

The flippable board 100 may further include a writing board 136 attached to the frame 110 and/or an acoustic panel 300. The acoustic panel 300 may be capable of attaching to a back portion of the writing board 302. The writing board 136 may be visible in the open position 404, and/or the acoustic panel 300 may be visible in the closed position 406. Additionally, the flippable board 100 may include a metal sheet 304 attached to the back portion of the writing board 302 and/or the panel magnet 306 attached to the acoustic panel 300. The acoustic panel 300 may be capable of attaching to the back portion of the writing board 302 using the panel magnet 306. The writing board 136 may be a glassboard.

The second hinge component 108 may include a receptacle 140 on a top portion of the second hinge component 138 capable of retaining a writing instrument 142. The writing instrument 142 may be capable of writing on the writing board 136. The first hinge component 106 and/or the second hinge component 108 may include pin hinges. The frame 110 may include a top hole 202 and/or a bottom hole 208 on the first vertical end. The first hinge component 106 may include a first pin hinge 204 and/or the second hinge component 108 may include a second pin hinge 206. The top hole 202 may be capable of attaching to the first pin hinge 204 and/or the bottom hole 208 may be capable of attaching to the second pin hinge 206. The top hole 202 and/or the bottom hole 208 may be located such that the frame 110 conceals the track 102 mounted to the surface 104 when the flippable board 100 is in the open position 404 and/or the closed position 406.

In another embodiment, a method of a flippable board 100 includes attaching a track 102 to a surface 104. The method further includes attaching a first hinge component 106 to a top end of the track 107 and attaching a second hinge component 108 to a bottom end of the track 109. A frame 110 is attached to the first hinge component 106 and the second hinge component 108 along a first vertical end of the frame 112. The first hinge component 106 and the second hinge component 108 are capable of allowing the flippable board 100 to rotate between an open position 404 and/or a closed position 406 about an axis along the first vertical end 200 of the frame 110.

The left magnet 114 is attached to a first hinge component left portion 116 and/or a second hinge component left portion 118. The right magnet 120 is attached to a first hinge component right portion 122 and/or a second hinge component right portion. The metal sleeve 126 is attached to a top portion 128 and/or a bottom portion 130 of a second vertical end of the frame 132. The metal sleeve 126 is capable of connecting to the left magnet 114 of a secondary flippable board 402, the right magnet 120 of a secondary flippable board 402, and/or a surface magnet 134 in order to secure the flippable board 100 in the open position 404 and/or the closed position 406. The surface magnet 134 is attached to the surface 104. Each of the left magnet 114, the right magnet 120, and/or the surface magnet 134 is capable of being adjusted towards and/or away from the surface 104 in order to compensate for inconsistencies in the surface 104.

In yet another aspect, a system includes a primary flippable board 400 and a secondary flippable board 402. Each flippable board 100 includes a track 102 attached to a surface 104, a first hinge component 106 attached to a top end of the track 107, a second hinge component 108 attached to a bottom end of the track 109, and a frame 110 attached to the first hinge component 106 and the second hinge component 108 along a first vertical end of the frame 112. The first hinge component 106 and the second hinge component 108 are capable of allowing the frame 110 to rotate between an open position 404 and/or a closed position 406 about an axis along the first vertical end 200 of the frame 110.

Each flippable board 100 further includes a left magnet 114 attached to a first hinge component left portion 116 and/or a second hinge component left portion 118, and a right magnet 120 attached to a first hinge component right portion 122 and/or a second hinge component right portion. Additionally, each flippable board 100 includes a metal sleeve 126 attached to a top portion 128 and/or a bottom portion 130 of a second vertical end of the frame 132. The track 102 of the secondary flippable board 402 is attached to the surface 104 at a specific distance from the primary flippable board 400 such that the metal sleeve 126 of the primary flippable board 400 is capable of connecting to the left magnet 114 of the secondary flippable board 402 and/or the right magnet 120 of the secondary flippable board 402 in order to secure the primary flippable board 400 in the open position 404 and/or the closed position 406.

The system further includes a surface magnet 134 attached to the surface 104 at the specific distance from the primary flippable board 400 and/or the secondary flippable board 402 such that the metal sleeve 126 of the primary flippable board 400 and/or the secondary flippable board 402 is capable of connecting to the surface magnet 134 in order to secure the primary flippable board 400 and/or the secondary flippable board 402 in the open position 404 and/or the closed position 406. Each of the left magnet 114, the right magnet 120, and the surface magnet 134 is capable of being adjusted towards and/or away from the surface 104 in order to compensate for inconsistencies in the surface 104.

FIG. 1 is a flippable board view 150, according to one embodiment. Particularly, the flippable board view 150 includes a flippable board 100, a track 102, a surface 104, a first hinge component 106, a top end of track 107, second hinge component 108, a bottom end of track 109, a frame 110, a first vertical end of frame 112, a left magnet 114, a first hinge component left portion 116, a second hinge component left portion 118, a right magnet 120, a first hinge component right portion 122, a second hinge component right portion 124, a metal sleeve 126, a top portion 128, a bottom portion 130, a second vertical end of frame 132, a surface magnet 134, a writing board 136, a top portion of the of the second hinge component 138, a receptacle 140, and a writing instrument 142, according to one embodiment.

The flippable board 100 may be a piece of equipment capable of being mounted to a wall and flipped between a front surface and a back surface. According to another embodiment, the flippable board 100 may include a writing board 136 and/or an acoustic panel 300 which allows a user to easily switch between the writing board 136 and/or the acoustic panel 300. The track 102 may be a rigid structural unit capable of mounting to the surface 104 and providing support to the flippable board 100. According to one embodiment, the track 102 may attach to the surface 104 using screws. The surface 104 may be a two-dimensional, topological manifold. According to one embodiment, the surface 104 may be a wall in a building and/or room.

The first hinge component 106 and/or the second hinge component 108 may be a structural unit that includes a hinge (e.g., a first pin hinge 204 and/or a second pin hinge 206). The first hinge component 106 and/or the second hinge component 108 may connect two solid objects, for example, through the hinge (e.g., the first pin hinge 204 and/or the second pin hinge 206), typically allowing only a limited angle of rotation between them. According to one embodiment, the first hinge component 106 and/or the second hinge component 108 may connect the frame 110 to the track 102 along a first vertical end 200 of the frame 110. The first hinge component 106 may attach to the top end of the track 107, and the second hinge component 108 may attach to the bottom end of the track 109. According to a further embodiment, the first hinge component 106 and/or the second hinge component 108 are capable of allowing the frame 110 to rotate between an open position 404 and/or a closed position 406 about an axis along the first vertical end 200 of the frame 110. In yet another embodiment, the first hinge component 106 and/or the second hinge component 108 may comprise pin hinges (e.g., the first pin hinge 204 and/or the second pin hinge 206).

The frame 110 may be a structural system that supports other components of a physical construction. According to one embodiment, the frame 110 may support the writing board 136. In a further embodiment, the frame 110 may be a single unit that comprises the writing board 136. In other embodiments, the frame 110 may be a decorative edging for a picture, such as a painting or photograph, intended to enhance it, make it easier to display, and/or protect it. The first vertical end of frame 112 may be a vertical edge of the frame 110 that may attach to the first hinge component 106 and/or the second hinge component 108.

The left magnet 114, the right magnet 120, and/or the surface magnet 134 may be a material or object that produces a magnetic field and has a magnetic force that pulls on other ferromagnetic materials, such as iron, steel, and/or other metals, and attracts or repels other magnets. According to one embodiment, the left magnet 114, the right magnet 120, and/or the surface magnet 134 may be permanent magnets. In yet additional embodiments, the left magnet 114, the right magnet 120, and/or the surface magnet 134 may be capable of being adjusted towards and/or away from the surface 104 in order to compensate for inconsistencies in the surface 104, for example using threads on the left magnet 114, the right magnet 120, and/or the surface magnet 134.

The first hinge component left portion 116 and/or the second hinge component left portion 118 may be portions of the first hinge component 106 and/or the second hinge component 108, respectively, that are on a left end of the first hinge component 106 and/or the second hinge component 108 when the flippable board 100 is mounted to the surface 104. The first hinge component right portion 122 and/or the second hinge component right portion 124 may be portions of the first hinge component 106 and/or the second hinge component 108, respectively, that are on a right end of the first hinge component 106 and/or the second hinge component 108 when the flippable board 100 is mounted to the surface 104.

In various embodiments, at least one left magnet (left magnet 114) is attached to the first hinge component left portion 116 and/or the second hinge component left portion 118, for example, using a screw, and at least one right magnet (right magnet 120) is attached to the first hinge component right portion 122 and/or the second hinge component right portion 124, for example, using a screw. In further embodiments, the surface magnet 134 is attached to the surface 104, for example, using a screw.

The metal sleeve 126 may be a material or object comprised of a ferromagnetic material, such as iron, a steel, and/or other metal, that is capable of being pulled by a magnet. The second vertical end of frame 112 may be a vertical edge of the frame 110 that is not attached to the first hinge component 106 and/or the second hinge component 108. According to one embodiment, the metal sleeve 126 may be configured to attach to a top portion 128 and/or a bottom portion 130 of the second vertical end of the frame 132. In further embodiments, the metal sleeve 126 is capable of connecting to at least one left magnet (left magnet 114) of a secondary flippable board 402, at least one right magnet (right magnet 120) of the secondary flippable board 402, and/or the surface magnet 134 in order to secure the flippable board 100 in the open position 404 and/or the closed position 406.

The writing board 136 may be a smooth surface to be written upon using an erasable material. In various embodiments, the writing board 136 may be large enough for several persons to read simultaneously. In some preferred embodiments, the writing board 136 may be attached to the frame 110 and/or may be a glassboard. In yet additional embodiments, the writing board 136 may be a white board, chalkboard, and/or a blackboard. According to one preferred embodiment, the writing board 136 may be visible when the flippable board 100 is in the open position 404.

The top portion of the second hinge component 138 may include the receptacle 140. The receptacle 140 may be a container used to hold something. According to one embodiment, the receptacle 140 may be a hole located in the top portion of the second hinge component 138 configured to hold the writing instrument 142. The writing instrument 142 may be a tool capable of writing on the writing board 136. According to various embodiments, the writing instrument 142 may be a dry-erase marker, a piece of chalk, a marker, a pen, and/or a pencil.

Figure 2B:
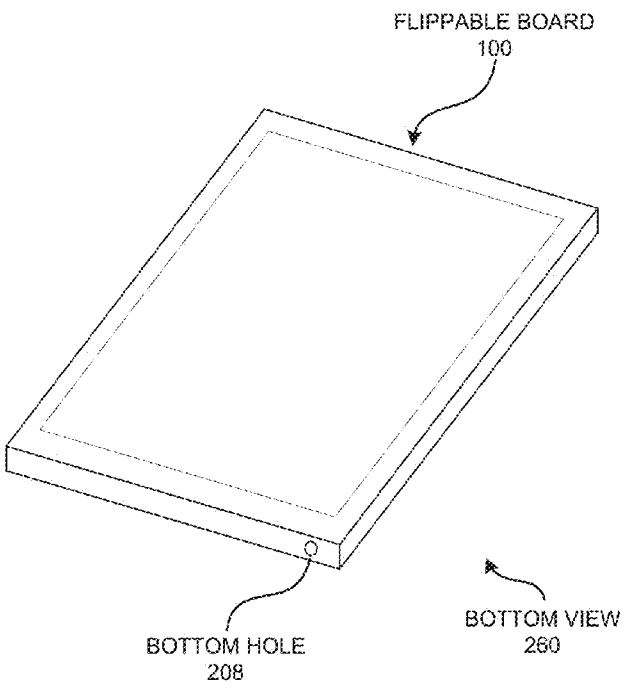
FIG. 2B is a bottom view of the flippable board of FIG. 1, according to one embodiment.
Figure 2A:
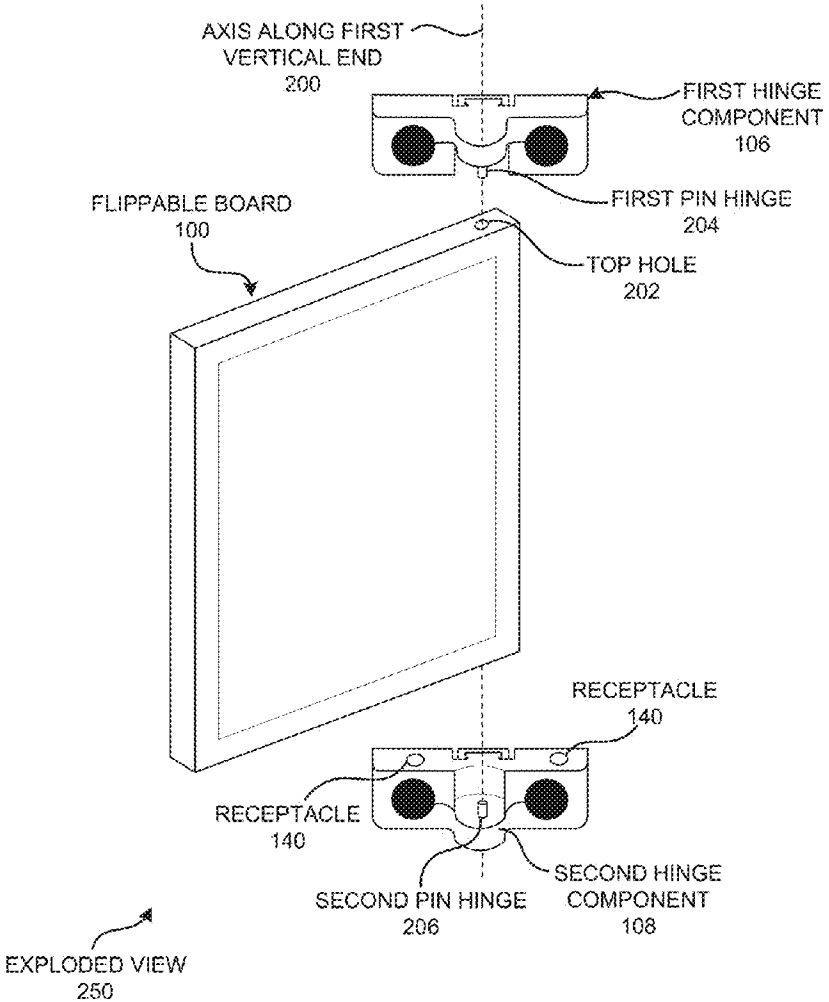
FIG. 2A is an exploded view of the flippable board of FIG. 1, according to one embodiment.

FIG. 2A is an exploded view 250 of the flippable board 100 of FIG. 1, according to one embodiment. Particularly, the exploded view 250 further includes an axis along first vertical end 200, a top hole 202, a first pin hinge 204, and a second pin hinge 206.

The axis along first vertical end 200 may be an imaginary line around which the flippable board 100 may rotate. According to one embodiment, the axis along first vertical end 200 may be located along the first vertical end of frame 112. The top hole 202 may be a hole located in the frame 110. The first pin hinge 204 and/or the second pin hinge 206 may be a jointed or flexible device that allows the turning or pivoting of a part on a stationary frame. According to various embodiments, the first pin hinge 204 and/or the second pin hinge 206 may be mechanisms of the first hinge component 106 and/or the second hinge component 108, respectively.

FIG. 2B is a bottom view 260 of the flippable board 100 of FIG. 1, according to one embodiment. Specifically, the bottom view 260 includes a bottom hole 208. The bottom hole 208 may be a hole located in the frame 110. According to various embodiments, the top hole 202 and/or the bottom hole 208 may be located on the first vertical end of frame 112. In further embodiments, the top hole 202 may be capable of attaching to the first pin hinge 204 and/or the bottom hole 208 may be capable of attaching to the second pin hinge 206. In some preferred embodiments, the top hole 202 and/or the bottom hole 208 may be located such that the frame 110 conceals the track 102 mounted to the surface 104 when the flippable board 100 is in the open position 404 and/or the closed position 406.

Figure 3:
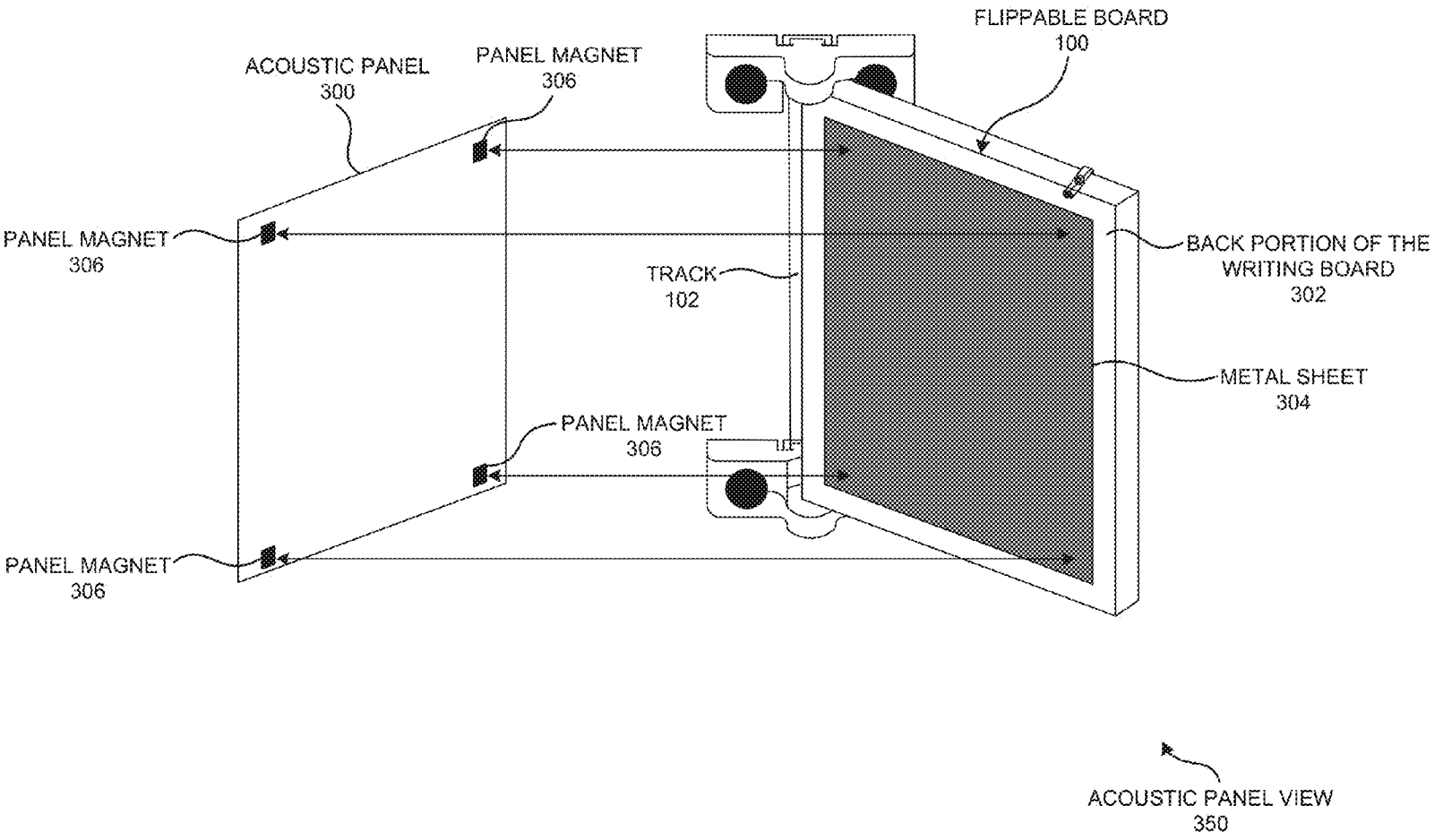
FIG. 3 is an acoustic panel view of the flippable board of FIG. 1, according to one embodiment.

FIG. 3 is an acoustic panel view 350 of the flippable board 100 of FIG. 1, according to one embodiment. Specifically, the acoustic panel view 350 includes an acoustic panel 300, a back portion of the writing board 302, a metal sheet 304, and a panel magnet 306.

The acoustic panel 300 may be a special kind of board made of sound absorbing materials that is capable of providing sound insulation. When sound passes through the acoustic panel 300, the intensity of the sound is decreased. According to various embodiments, the acoustic panel 300 is capable of attaching to the back portion of the writing board 302. In some preferred embodiments, the acoustic panel 300 may be visible when the flippable board 100 is in the closed position 406.

The metal sheet 304 may be a thin, flat piece of metal, for example a ferromagnetic material such as iron and/or steel, capable of being pulled by a magnet (e.g., the panel magnet 306.) According to some embodiments, the metal sheet 304 may be attached to the back portion of the writing board 302. The panel magnet 306 may be a material or object that produces a magnetic field and has a magnetic force that pulls on other ferromagnetic materials, such as iron, steel, and/or other metals, and attracts or repels other magnets. According to one embodiment, the panel magnet 306 may be attached to the acoustic panel 300. In some preferred embodiments, the acoustic panel 300 attaches to the back portion of the writing board 302 using the panel magnet 306, such that the panel magnet 306 attracts the metal sheet 304 in order to create the attachment.

Figure 4A:
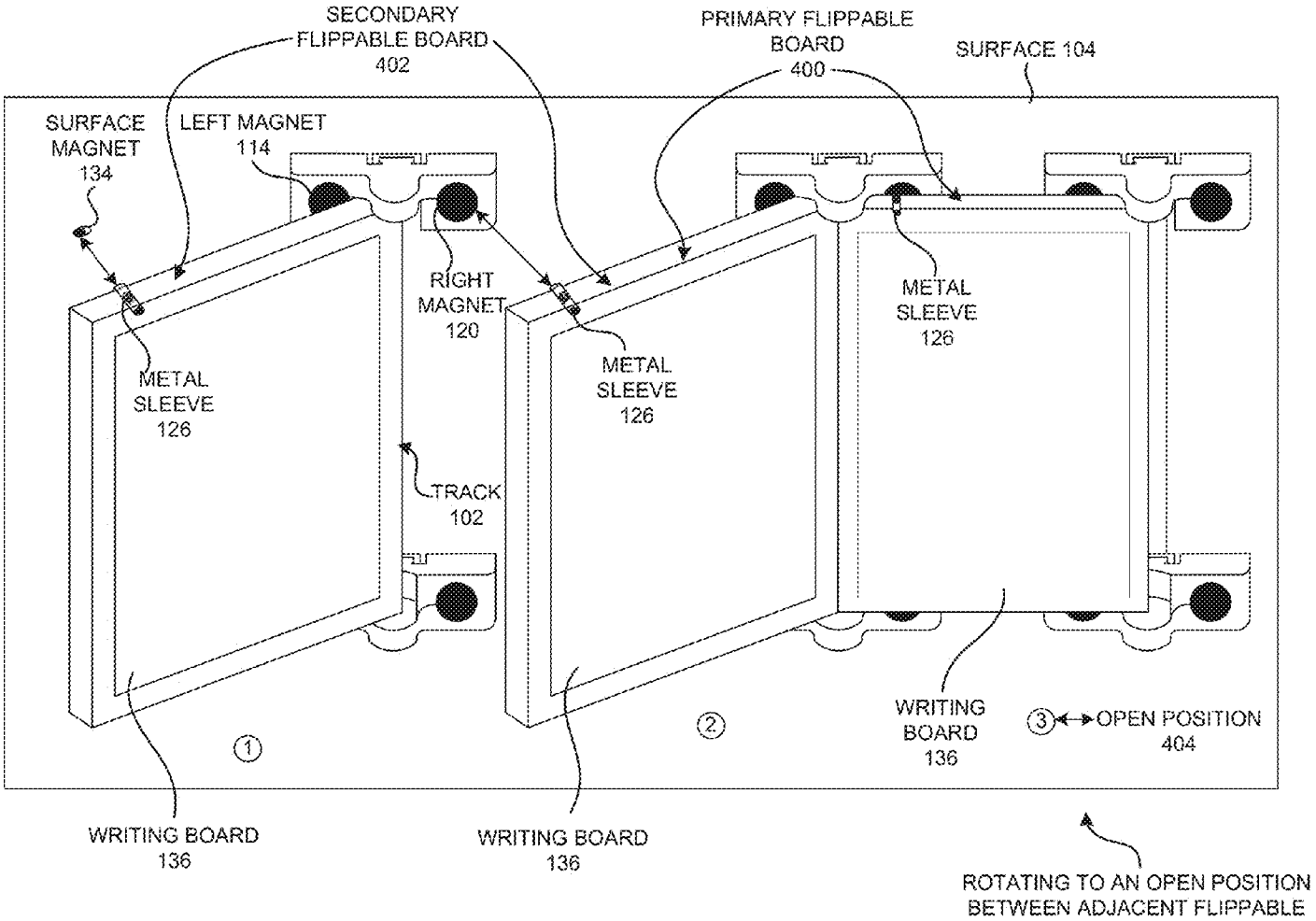
FIG. 4A is a rotating to an open position between adjacent flippable boards view, according to one embodiment.

FIG. 4A is a rotating to an open position between adjacent flippable boards view 450, according to one embodiment. Particularly, FIG. 4A contains a primary flippable board 400, and a secondary flippable board 402. The primary flippable board 400 and/or the secondary flippable board 402 may be flippable boards similar to the flippable board 100 of FIGS. 1-3. According to various embodiments, the secondary flippable board 402 may be mounted on the surface 104 adjacent to the primary flippable board 400.

Circle '1' to Circle '3' shows flippable boards (e.g., the primary flippable board 400 and/or the secondary flippable board 402) being rotated on the surface 104 into an open position 404. According to some embodiments, the metal sleeve of a flippable board 100 without an adjacent board on one side (e.g., the secondary flippable board shown in Circle '1') may connect to a surface magnet 134 attached to the surface 104. Circle '1' shows that the surface magnet 134 is located at a specific distance from the secondary flippable board 402 of Circle '1' such that the metal sleeve 126 will align with the surface magnet 134 when the secondary flippable board 402 is rotated into the open position 404, according to some embodiments.

According to some embodiments, the metal sleeve of a flippable board 100 with an adjacent board (e.g., the secondary flippable board 402 and/or the primary flippable board 400 shown in Circle '2' and/or Circle '3') may connect to a right magnet 120 of the adjacent flippable board (e.g., the secondary flippable board 402 and/or the primary flippable board 400 shown in Circle '1' and/or Circle '2'.) Particularly, Circle '2' and Circle '3' show that the right magnet 120 is located at a specific distance from the secondary flippable board 402 and/or the primary flippable board 400 shown in Circle '2' and/or Circle '3' such that the metal sleeve 126 will align with the right magnet 120 when the secondary flippable board 402 and/or the primary flippable board 400 is rotated into the open position 404, according to some embodiments. Circle '3' shows, according to some preferred embodiments, that the writing board 136 is visible in the open position 404. In yet further embodiments, as shown in Circle '3', the track 102 is not visible when the flippable board 100 (e.g., the primary flippable board 400) is in the open position 404, providing a more pleasing aesthetic. In some preferred embodiments, when the metal sleeve 126 connects to the right magnet 120 and/or the surface magnet 134, the connection will hold the flippable board 100 (e.g., the primary flippable board 400 and/or the secondary flippable board 402) in the open position 404 in a stable condition such that a user of the flippable board 100 can write on the writing board 136 without the flippable board 100 moving out of position without the user intending such.

Figure 4B:
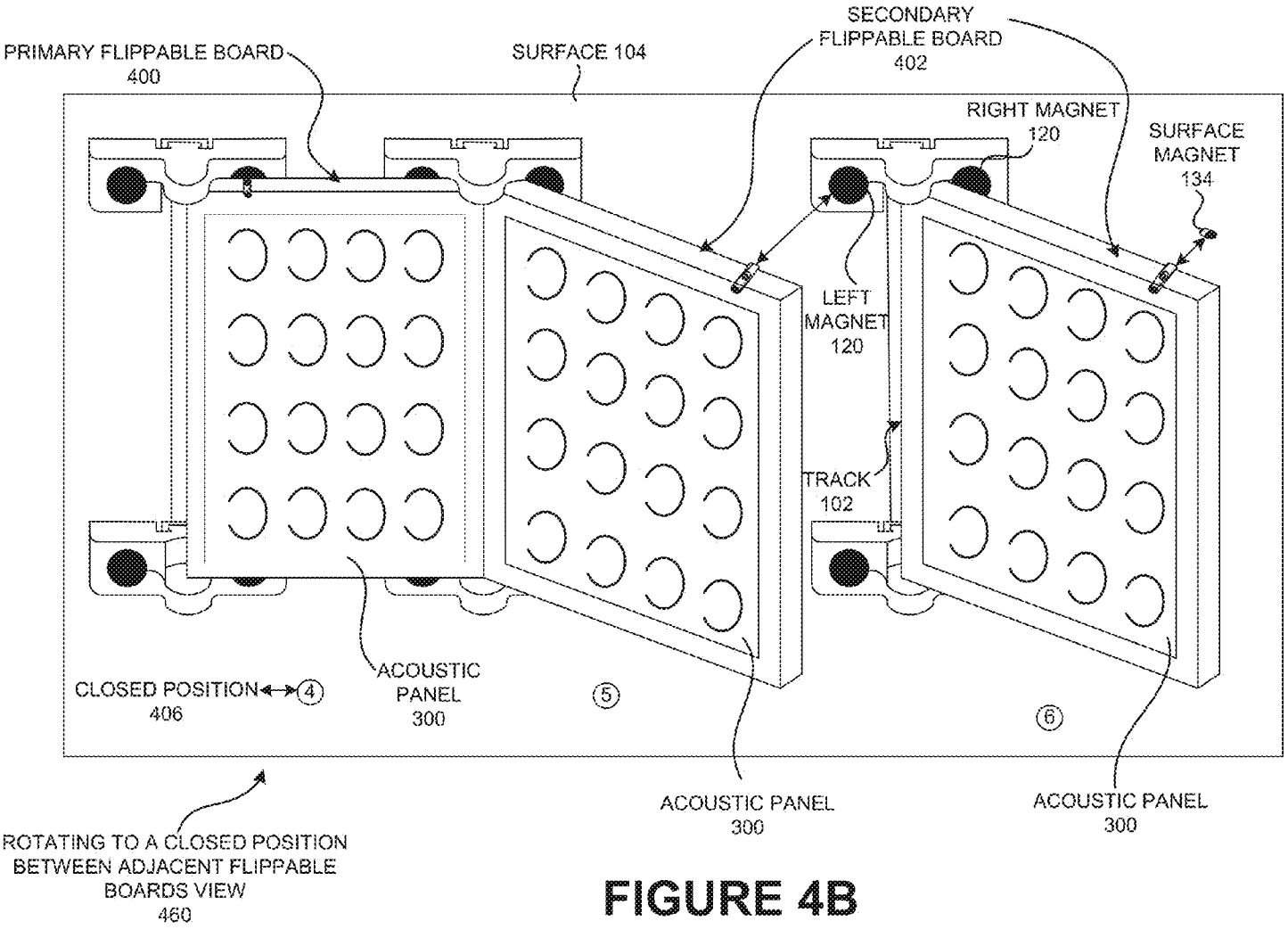
FIG. 4B is a rotating to a closed position between adjacent flippable boards view, according to one embodiment.

FIG. 4B is a rotating to a closed position between adjacent flippable boards view 450, according to one embodiment. Particularly, Circle '4' to Circle '6' shows flippable boards (e.g., the primary flippable board 400 and/or the secondary flippable board 402) being rotated on the surface 104 into the closed position 406.

Circle '4' to Circle '6' shows flippable boards (e.g., the primary flippable board 400 and/or the secondary flippable board 402) being rotated on the surface 104 into the closed position 406. According to some embodiments, the metal sleeve of a flippable board 100 with an adjacent board (e.g., the secondary flippable board 402 and/or the primary flippable board 400 shown in Circle '4' and/or Circle '5') may connect to a left magnet 114 of the adjacent flippable board (e.g., the secondary flippable board 402 and/or the primary flippable board 400 shown in Circle '5' and/or Circle '6'.) Particularly, Circle '4' and Circle '5' show that the left magnet 114 is located at a specific distance from the secondary flippable board 402 and/or the primary flippable board 400 shown in Circle '4' and/or Circle '5' such that the metal sleeve 126 will align with the left magnet 114 when the secondary flippable board 402 and/or the primary flippable board 400 is rotated into the closed position 406, according to some embodiments. Circle '4' shows, according to some preferred embodiments, that the acoustic panel 300 is visible in the closed position 406. The acoustic panel 300 may provide acoustic benefits, suppressing sound in the room. Further, by having the acoustic panel 300 visible in the closed position 406, the writing board 136 is hidden from view and provides privacy when the user does not want material written on the writing board 136 to be seen. In yet further embodiments, as shown in Circle '4', the track 102 is not visible when the flippable board 100 (e.g., the primary flippable board 400) is in the closed position 406, providing a more pleasing aesthetic.

According to some embodiments, the metal sleeve of a flippable board 100 without an adjacent board on one side (e.g., the secondary flippable board shown in Circle '6') may connect to a surface magnet 134 attached to the surface 104. Circle '6' shows that the surface magnet 134 is located at a specific distance from the secondary flippable board 402 of Circle '5' such that the metal sleeve 126 will align with the surface magnet 134 when the secondary flippable board 402 is rotated into the open position 404, according to some embodiments. In some preferred embodiments, when the metal sleeve 126 connects to the left magnet 114 and/or the surface magnet 134, the connection will hold the flippable board 100 (e.g., the primary flippable board 400 and/or the secondary flippable board 402) in the closed position 406 in a stable condition such that the flippable board 100 will not moving out of position without the user intending such.

Figure 5:
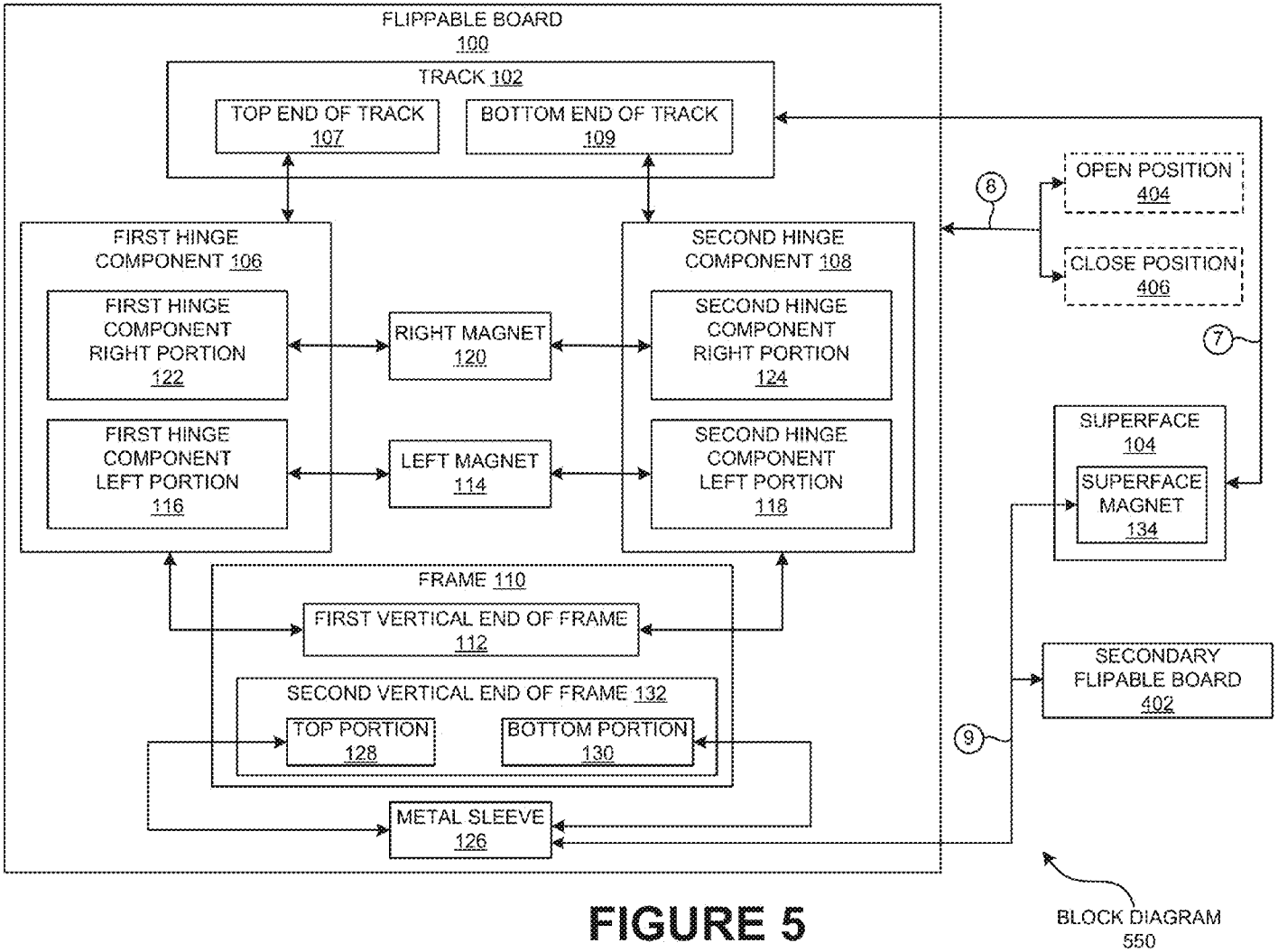
FIG. 5 is a block diagram of the flippable board of FIG. 1, according to one embodiment.

FIG. 5 is a block diagram 550 of the flippable board 100 of FIG. 1, according to one embodiment. The flippable board 100 includes track 102, first hinge component 106, second hinge component 108, frame 110, left magnet 114, and right magnet 120, according to one embodiment. The first hinge component 106 is connected to top end of track 107 and first vertical end of frame 112. The second hinge component 108 is connected to bottom end of track 109 and first vertical end of frame 112. The left magnet 114 is associated with first hinge component left portion 116 and/or second hinge component left portion 118. The metal sleeve 126 is associated with top portion 128 and/or bottom portion 130 of second vertical end of frame 132, according to one embodiment.

Further, in Circle '7' the track 102 is attached to surface 104, according to various embodiments. In Circle '8' the first hinge component 106 and the second hinge component 108 are capable of allowing the frame 110 to rotate between an open position 404 and/or a closed position 406 about an axis along the first vertical end of the frame 112. In Circle '9' the metal sleeve 126 connects to secondary flippable board 402 and/or a surface magnet 134 in order to secure the flippable board 100 in the open position 404 and/or the closed position 406 according to one embodiment.

Figure 6:
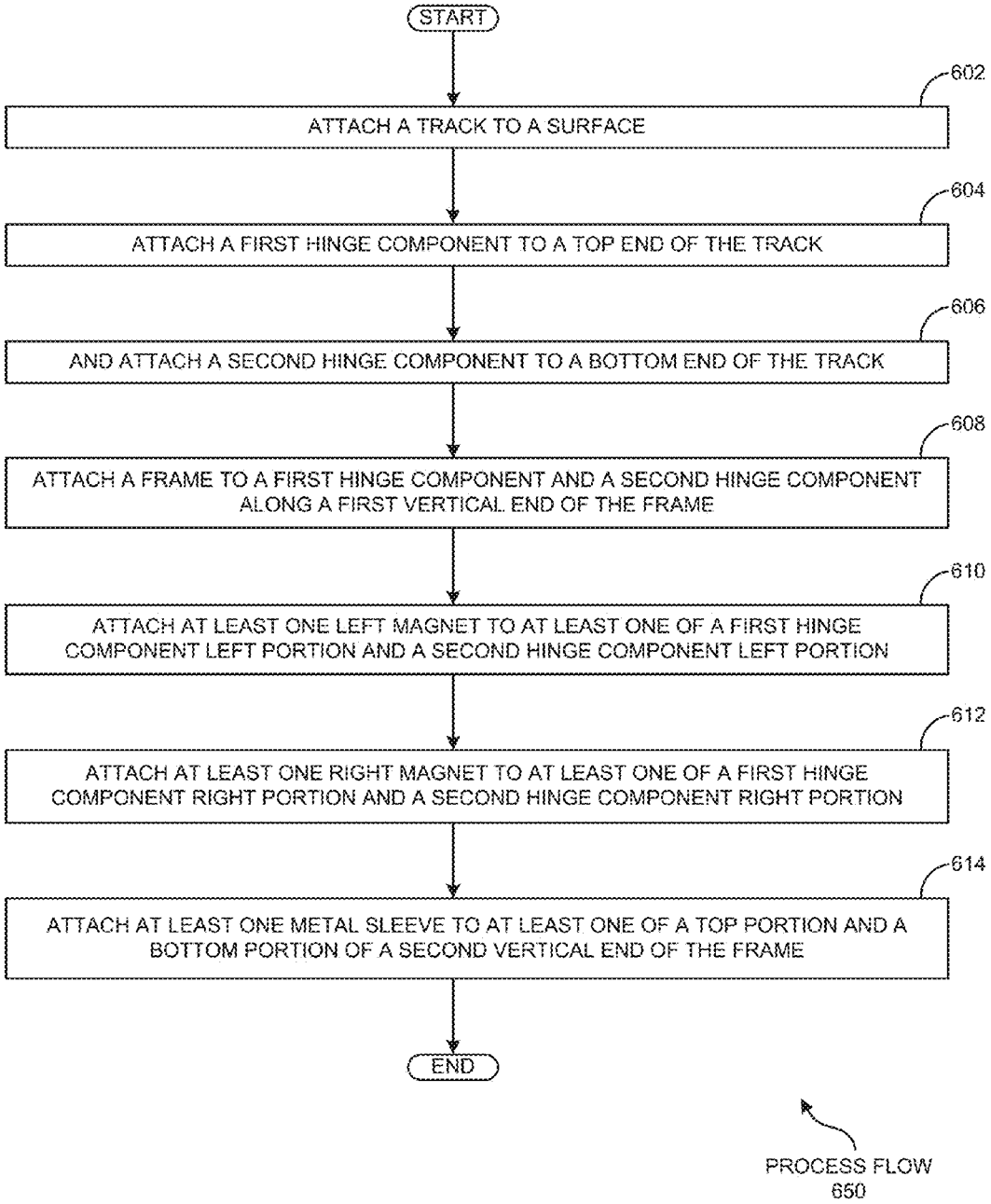
FIG. 6 is a process flow of the flippable board of FIG. 1, according to one embodiment.

FIG. 6 is a process flow 650 of the flippable board 100 of FIG. 1, according to one embodiment. In operation 602, the track 102 is attached to the surface 104. In operation 604, the first hinge component 106 is attached to the top end of track 107. In operation 606, the second hinge component 108 is attached to the bottom end of track 109. In operation 608, the frame 110 is attached to the first hinge component 106 and the second hinge component 108 along the first vertical end of the frame 112. In operation 610, at least one left magnet (left magnet 114) is attached to a first hinge component left portion 116 and/or a second hinge component left portion 118. In operation 612, at least one right magnet is attached to a first hinge component right portion 122 and/or a second hinge component right portion 124. In operation 614, the metal sleeve 126 is attached to the top portion 128 and/or a bottom portion 130 of a second vertical end of the frame 110, according to one embodiment.

An example embodiment may now be described. Sofia may be the owner of a new business, So Soft. Sofia may want her employees to use glassboards for collaborating and/or writing down their ideas throughout the work day. Sofia may have ordered two dozen free standing glassboards and two dozen mountable glassboards from Gary Glassboards to use throughout the office. Later, Sofia may realize that clients often come into the office and are able to view sensitive material written on both the free standing glassboards and the mounted boards. Sofia may find it cumbersome to cover the mounted glassboards and/or move the free standing glassboards. Sofia may be able to flip the free standing glassboards to an empty side thereby hiding the material from view. Sofia may look into purchasing cabinets that will hide the mounted glassboards from view when she does not want them to be seen, however, she may find that she cannot bear the additional cost and/or may find the cabinets unsightly.

Further, Sofia may realize that the free standing glassboards interfere with her vision of creating an open workspace environment. While the mounted glassboards may promote the open workspace environment, Sofia may also realize that the open space creates poor acoustic conditions and it is often difficult to hear colleagues when multiple employees are holding conversations at the same time. Sofia may look into purchasing acoustic panels that will help to dilute the sound in the office, however, she may find the installation of the acoustic panels to be too costly, time intensive and/or cumbersome when used in addition to the mounted glassboards.

Thankfully, Sofia may learn that Gary is selling the new flippable boards (as described in FIGS. 1-6). Sofia may decide to invest money and switch to using the flippable boards and replacing the free standing and mounted glassboards she had previously purchased from Gary. Sofia may find that the new flippable boards allow her to use a single item that provides her employees with a writable surface that does not interfere with the open workspace environment and that easily conceals material written on the flippable boards when necessary, while providing acoustic benefits all at the same time. Further, Sofia may learn that she can customize the acoustic panels of the flippable boards to illustrate the So Soft logo and promote her business when the acoustic panels are visible. Sofia's employees may even notice how easy it is to reorient cover the written material when a client comes into the office and/or to dampen the sound in the office using the flippable board when too many conversations are taking place at the same time. Sofia may now recommend the new flippable glassboards to her colleagues and friends.

A number of embodiments have been described. Nevertheless, it will be understood that various modifications may be made without departing from the spirit and scope of the claimed invention. Accordingly, other embodiments are within the scope of the following claims.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. A flippable board comprising:

a track, wherein the track is capable of being attached to a surface;

a first hinge component attached to a top end of the track;

a second hinge component attached to a bottom end of the track;

a frame attached to the first hinge component and the second hinge component along a first vertical end of the frame, wherein the first hinge component and the second hinge component are capable of allowing the frame to rotate between at least one of an open position and a closed position about an axis along the first vertical end of the frame;

at least one left magnet attached to at least one of a first hinge component left portion and a second hinge component left portion;

at least one right magnet attached to at least one of a first hinge component right portion and a second hinge component right portion; and at least one metal sleeve attached to at least one of a top portion and a bottom portion of a second vertical end of the frame, wherein the at least one metal sleeve is capable of connecting to at least one of the at least one left magnet of a secondary flippable board, the at least one right magnet of the secondary flippable board, and a surface magnet in order to secure the flippable board in at least one of the open position and the closed position, wherein the surface magnet is attached to the surface, and wherein each of the at least one left magnet, the at least one right magnet, and the surface magnet is capable of being adjusted at least one of towards and away from the surface in order to compensate for inconsistencies in the surface.

2. The flippable board of claim 1, further comprising:

a writing board attached to the frame, an acoustic panel, wherein the acoustic panel is capable of attaching to a back portion of the writing board, wherein the writing board is visible in the open position, and wherein the acoustic panel is visible in the closed position.

3. The flippable board of claim 2, further comprising:

a metal sheet attached to the back portion of the writing board;

at least one panel magnet attached to the acoustic panel, wherein the acoustic panel is capable of attaching to the back portion of the writing board using the at least one panel magnet.

4. The flippable board of claim 2, wherein the writing board is a glassboard.

5. The flippable board of claim 2:

wherein the second hinge component comprises at least one receptacle on a top portion of the second hinge component capable of retaining a writing instrument, and wherein the writing instrument is capable of writing on the writing board.

6. The flippable board of claim 1, wherein the first hinge component and the second hinge component are comprised of pin hinges.

7. The flippable board of claim 1 wherein the frame comprises a top hole and a bottom hole on the first vertical end, wherein the first hinge component is comprised of a first pin hinge and the second hinge component is comprised of a second pin hinge, wherein the top hole is capable of attaching to the first pin hinge and the bottom hole is capable of attaching to the second pin hinge, and wherein the top hole and the bottom hole are located such that the frame conceals the track mounted to the surface when the flippable board is in at least one of the open position and the closed position.

8. A method of a flippable board, comprising:

attaching a track to a surface;

attaching a first hinge component to a top end of the track;

attaching a second hinge component to a bottom end of the track;

attaching a frame to the first hinge component and the second hinge component along a first vertical end of the frame, wherein the first hinge component and the second hinge component are capable of allowing the flippable board to rotate between at least one of an open position and a closed position about an axis along the first vertical end of the frame;

attaching at least one left magnet to at least one of a first hinge component left portion and a second hinge component left portion;

attaching at least one right magnet to at least one of a first hinge component right portion and a second hinge component right portion; and attaching at least one metal sleeve to at least one of a top portion and a bottom portion of a second vertical end of the frame;

wherein the at least one metal sleeve is capable of connecting to at least one of the at least one left magnet of a secondary flippable board, the at least one right magnet of the secondary flippable board, and a surface magnet in order to secure the flippable board in at least one of the open position and the closed position, wherein the surface magnet is attached to the surface, and wherein each of the at least one left magnet, the at least one right magnet, and the surface magnet is capable of being adjusted at least one of towards and away from the surface in order to compensate for inconsistencies in the surface.

9. The method of claim 8, further comprising:

attaching a writing board attached to the frame; and attaching an acoustic panel to a back portion of the writing board, wherein the writing board is visible in the open position, and wherein the acoustic panel is visible in the closed position.

10. The method of claim 9, further comprising:

attaching a metal sheet to the back portion of the writing board;

attaching at least one panel magnet to the acoustic panel, wherein the acoustic panel attaches to the back portion of the writing board using the at least one panel magnet.

11. The method of claim 9, wherein the writing board is a glassboard.

12. The method of claim 9:

wherein the second hinge component comprises at least one receptacle on a top portion of the second hinge component capable of retaining a writing instrument, and wherein the writing instrument is capable of writing on the writing board.

13. The method of claim 8, wherein the first hinge component and the second hinge component are comprised of pin hinges.

14. The method of claim 8 further comprises:

attaching a top hole of the frame to a first pin hinge of the first hinge component; and attaching a bottom hole of the frame to a second pin hinge of the second hinge component, wherein the top hole and the bottom hole are located such that the frame conceals the track mounted to the surface when the flippable board is in at least one of the open position and the closed position.

15. A system comprising:

a primary flippable board;

at least one secondary flippable board, each flippable board comprising:

a track attached to a surface;

a first hinge component attached to a top end of the track;

a second hinge component attached to a bottom end of the track;

a frame attached to the first hinge component and the second hinge component along a first vertical end of the frame, wherein the first hinge component and the second hinge component are capable of allowing the frame to rotate between at least one of an open position and a closed position about an axis along the first vertical end of the frame;

at least one left magnet attached to at least one of a first hinge component left portion and a second hinge component left portion;

at least one right magnet attached to at least one of a first hinge component right portion and a second hinge component right portion; and at least one metal sleeve attached to at least one of a top portion and a bottom portion of a second vertical end of the frame, wherein the track of the at least one secondary flippable board is attached to the surface at a specific distance from a primary flippable board such that the at least one metal sleeve of the primary flippable board is capable of connecting to at least one of the at least one left magnet of the at least one secondary flippable board and the at least one right magnet of the at least one secondary flippable board in order to secure the primary flippable board in at least one of the open position and the closed position; and at least one surface magnet attached to the surface at the specific distance from at least one of the primary flippable board and the at least one secondary flippable board such that the at least one metal sleeve of at least one of the primary flippable board and the at least one secondary flippable board is capable of connecting to the at least one surface magnet in order to secure at least one of the primary flippable board and the at least one secondary flippable board in at least one of the open position and the closed position, wherein each of the at least one left magnet, the at least one right magnet, and the at least one surface magnet is capable of being adjusted at least one of towards and away from the surface in order to compensate for inconsistencies in the surface.

16. The system of claim 15, wherein each flippable board further comprises:

a writing board attached to the frame, an acoustic panel, wherein the acoustic panel is capable of attaching to a back portion of the writing board, wherein the writing board is visible in the open position, and wherein the acoustic panel is visible in the closed position.

17. The system of claim 16, wherein each flippable board further comprises:

a metal sheet attached to the back portion of the writing board;

at least one panel magnet attached to the acoustic panel, wherein the acoustic panel is capable of attaching to the back portion of the writing board using the at least one panel magnet.

18. The system of claim 16, wherein the writing board is a glassboard.

19. The system of claim 15, wherein the first hinge component and the second hinge component are comprised of pin hinges.

20. The system of claim 15:

wherein the frame comprises a top hole and a bottom hole on the first vertical end, wherein the first hinge component is comprised of a first pin hinge and the second hinge component is comprised of a second pin hinge, wherein the top hole is capable of attaching to the first pin hinge and the bottom hole is capable of attaching to the second pin hinge, and wherein the top hole and the bottom hole are located such that the frame conceals the track mounted to the surface when the flippable board is in at least one of the open position and the closed position.

* * * * *